United States Patent [19]

Klein et al.

[11] 4,411,150

[45] Oct. 25, 1983

[54] BACKGAUGE STRUCTURE

[75] Inventors: Dean A. Klein; Steven C. Davis, both of Lake City; Jerome J. Wroblewski, Red Wing, all of Minn.

[73] Assignee: Houdaille Industries, Inc., Fort Lauderdale, Fla.

[21] Appl. No.: 313,293

[22] Filed: Oct. 21, 1981

[51] Int. Cl.[3] ..... B21D 11/22

[52] U.S. Cl. ..... 72/461; 72/389

[58] Field of Search ..... 72/461, 389, 36, 386

[56] References Cited

U.S. PATENT DOCUMENTS

| | | | |
|---|---|---|---|
| 784,726 | 4/1905 | Yates | 72/461 |
| 2,924,260 | 2/1960 | Guarino | 72/36 |
| 3,225,584 | 12/1965 | Begg et al. | 72/461 |
| 3,377,713 | 4/1968 | Schiler | 33/174 |
| 3,421,359 | 1/1969 | Gibbs | 72/461 |
| 3,423,838 | 1/1969 | Hostal | 33/169 |
| 3,704,611 | 12/1972 | Hirsch | 72/36 |
| 3,740,996 | 6/1973 | Hix | 72/461 |
| 3,812,695 | 5/1974 | Roch | 72/461 |
| 3,826,119 | 7/1974 | Marotto | 72/461 |
| 4,055,070 | 10/1977 | Wingate et al. | 72/461 |
| 4,089,200 | 5/1978 | Wingate et al. | 72/389 |
| 4,192,168 | 3/1980 | Di Ciaccio | 72/389 |

*Primary Examiner*—Gene Crosby

*Attorney, Agent, or Firm*—Hill, Van Santen, Steadman & Simpson

[57] ABSTRACT

An improved backgauge structure for a metal working machine as, for example, a press brake with improved rotatable gauging fingers that can be rotated 90° and pulled out for replacement but which will not fall out and which are spring loaded so that the gauging fingers can pivot upwardly in response to movement of the material and further including a pivoted channel member to which the gauging fingers are attached so as to provide improved gauging.

4 Claims, 10 Drawing Figures

FIG. 6
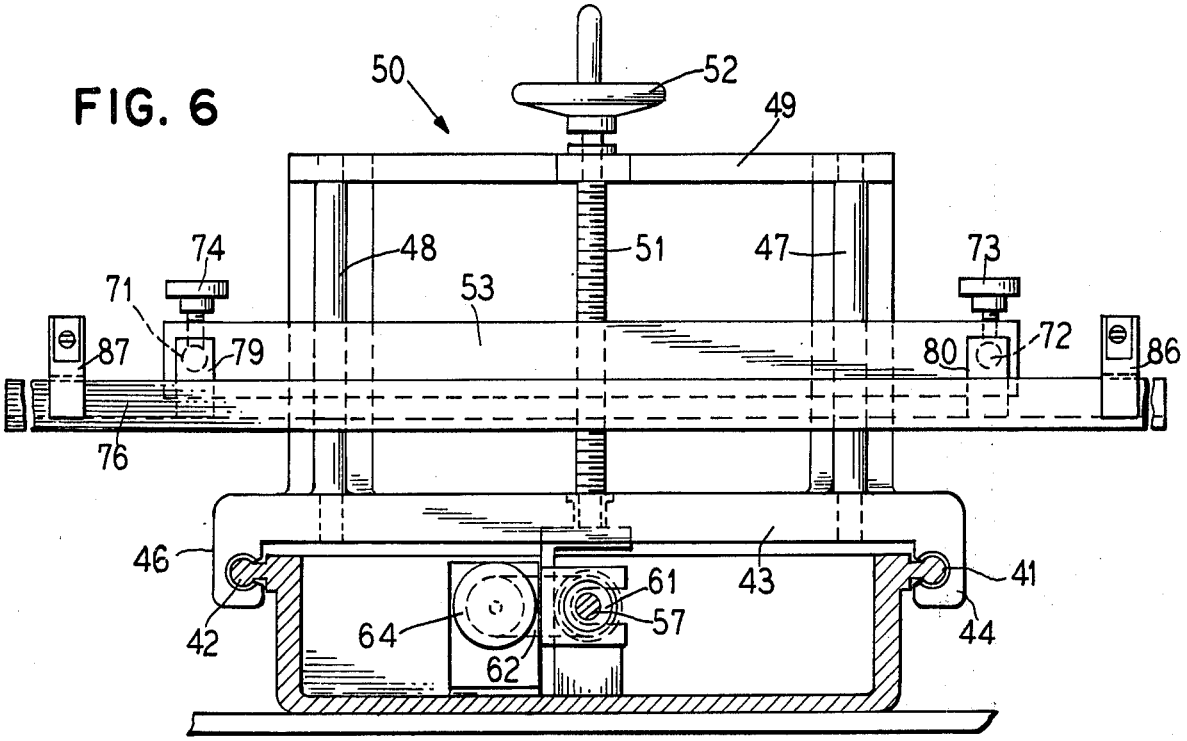
FIG. 7
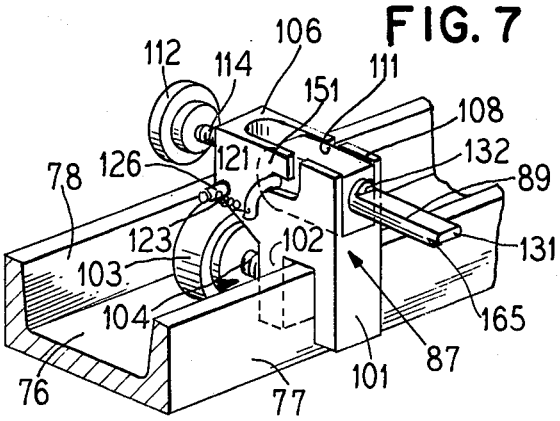
FIG. 9
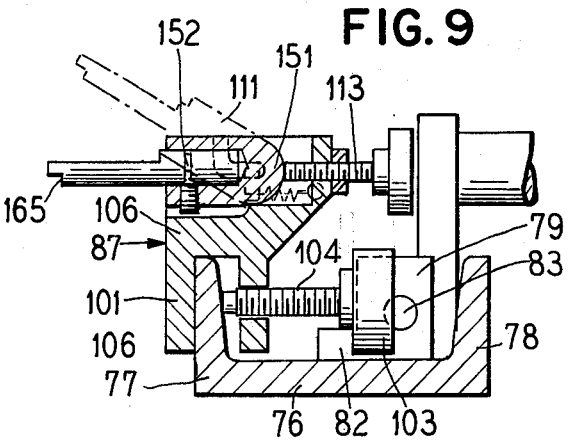
FIG. 8
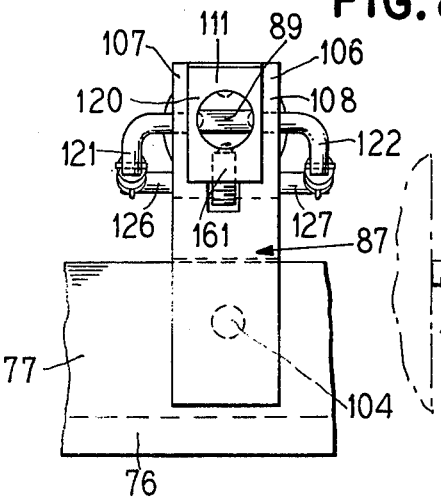
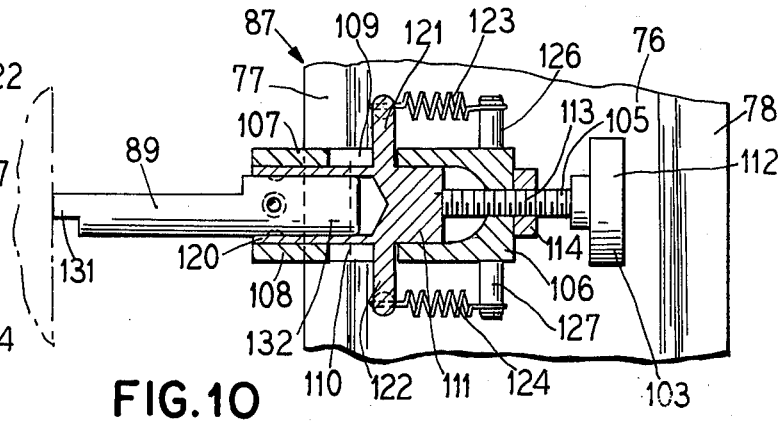
FIG. 10

BACKGAUGE STRUCTURE

BACKGROUND OF THE INVENTION

1. Field of the Invention

This invention relates in general to a backgauge and in particular to an improved backgauge for a metal working machine.

2. Description of the Prior Art

Backgauges for metal forming machines are well known in the art as shown, for example, by U.S. Pat. Nos. 4,192,168; 4,055,070; 3,826,119 and 3,812,695.

SUMMARY OF THE INVENTION

The present invention relates to a novel gauging finger bracket which pivotally supports the gauging fingers so that they can be pivoted upwardly as well as being adjustable and rotatably to different positions. The fingers can also be adjusted for forward and back reference positions by set screws.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 6 is a rear view of the gauging apparatus;

FIG. 7 is a perspective view of the gauging fingers;

FIG. 8 is a front view of the gauging fingers;

FIG. 9 is a sectional view of the gauging fingers; and

FIG. 10 is a sectional view of the gauging fingers.

DESCRIPTION OF THE PREFERRED EMBODIMENTS

Figure 1:
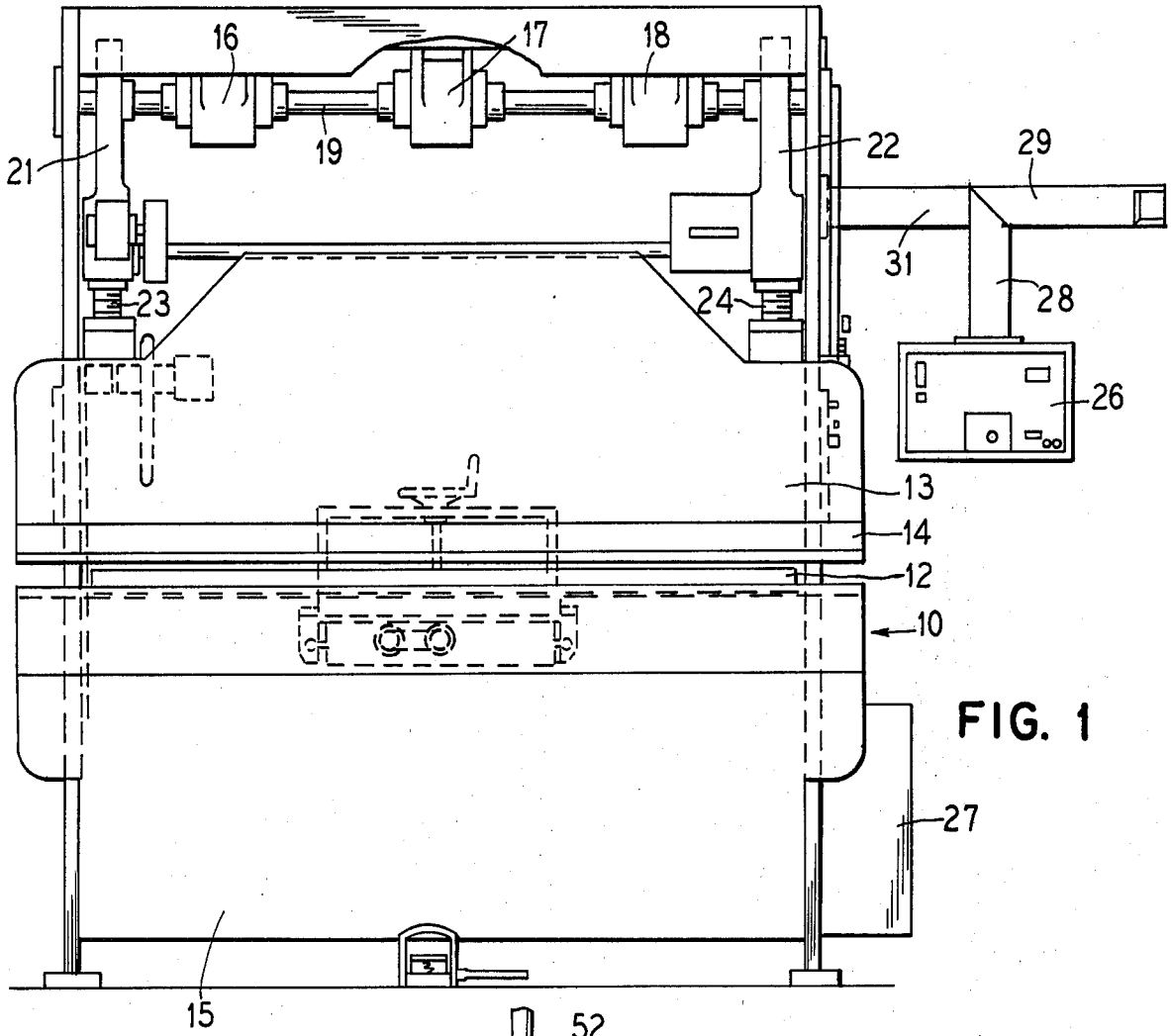
FIG. 1 is a front plan view of a press brake with the invention installed therein.
Figure 5:
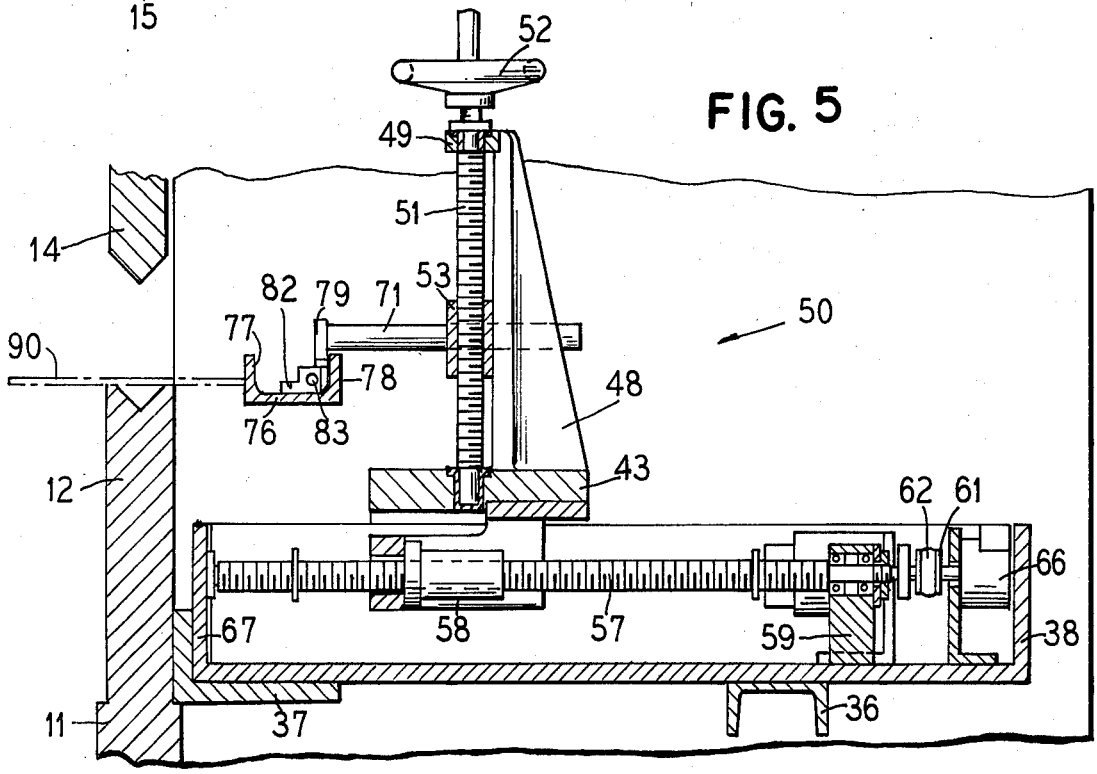
FIG. 5 is a side sectional view of the gauging system.
Figure 2:
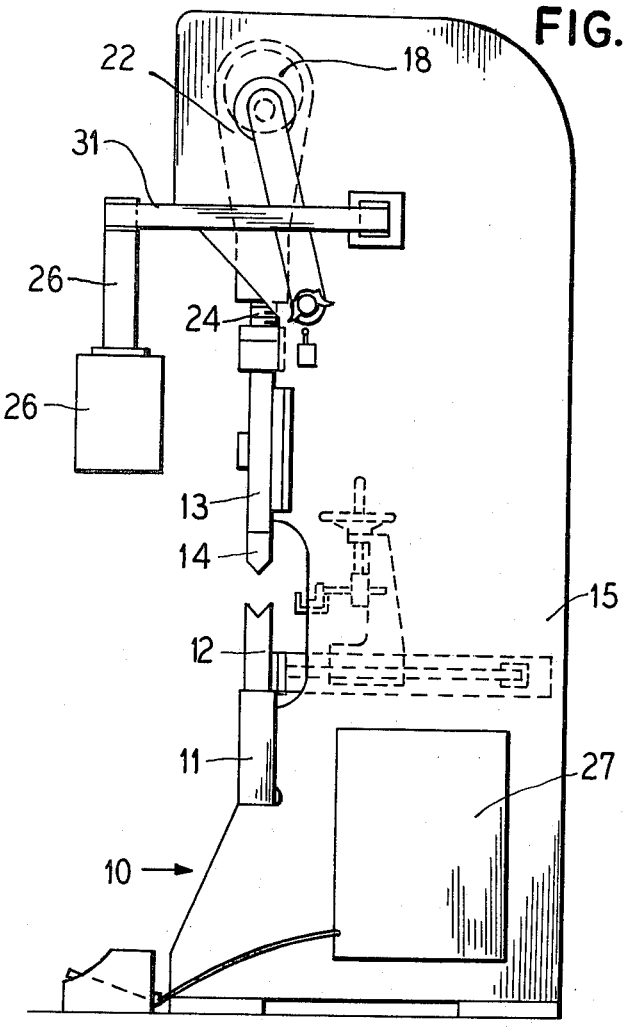
FIG. 2 is a side plan view of the press brake.
Figure 3:
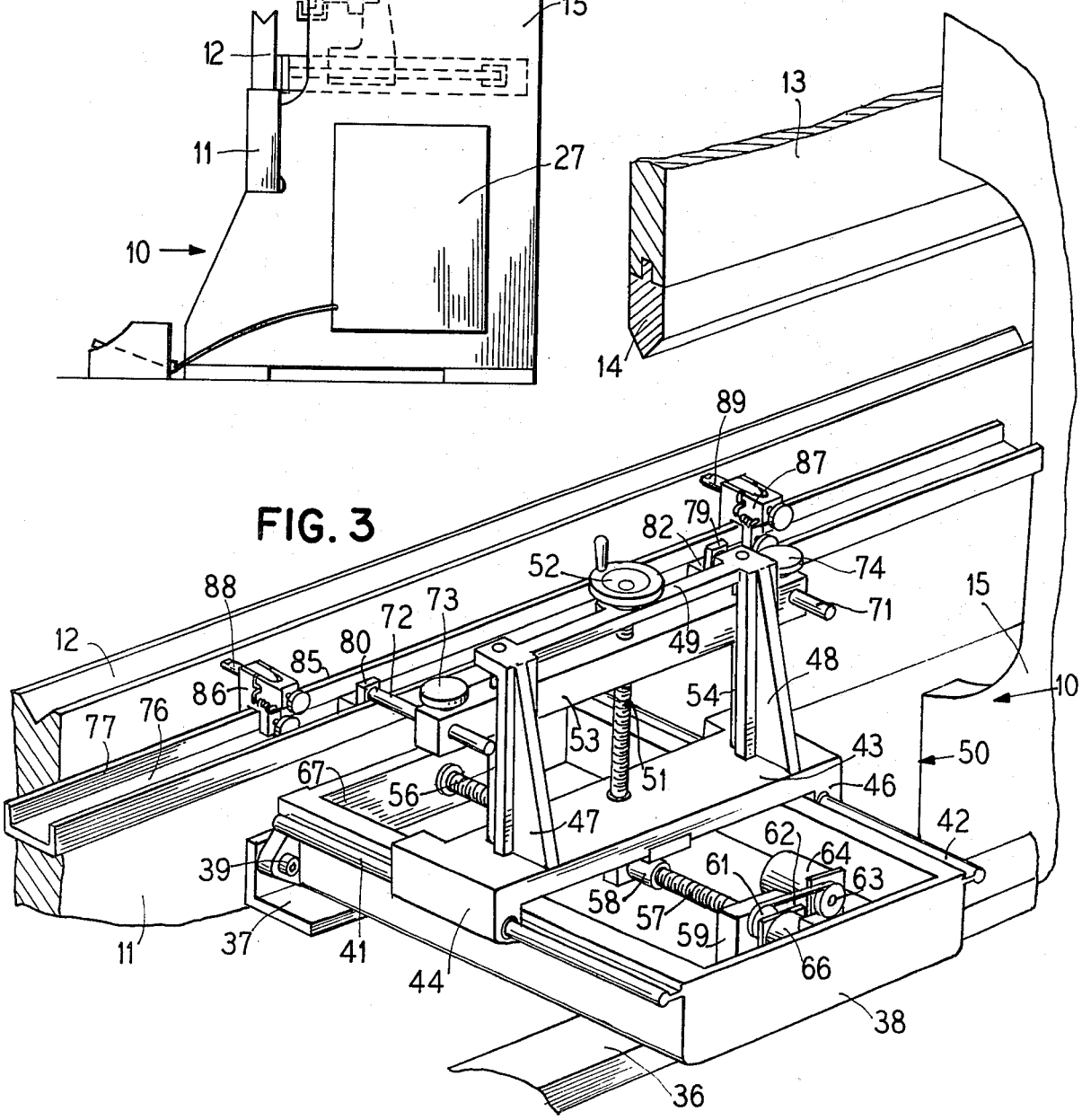
FIG. 3 is a perspective view of the gauging apparatus.

FIGS. 1 and 2 illustrate a press brake 10 comprising a main frame 15 with a lower die holder 11 in which a female die 12 is mounted in an upper movable ram 13 which carries a male die 14. The ram 13 is driven from a driving shaft 19 which is actuated by hydro-mechanical motors 16, 17 and 18 which drive through couplers 21 and 22 the upper ram 13. Adjustment means 23 and 24 are mounted between the ram 13 and the members 21 and 22 to allow vertical adjustment. A main computer 27 is mounted on the frame 15 and a controller operated station 26 is supported on arms 28, 29 and 31 from the frame of the machine. A back gauge 50 comprises a frame member 38 which is supported on cross-frame members 37 and 36 attached to the frame 15 of the machine by bolts 39. Side guides 41 and 42 are received in ways in carriage 43 through portions 44 and 46 so that the back guide can move backward and forward relative to the dies 12 and 14. The members 44 and 46 are relatively long so as to assure that the backgauge carriage 43 will be supported from the frame 38 so that it does not tilt or cock. A lead screw 57 shown in FIGS. 3 and 5 passes through a threaded portion 58 of the carriage 43 and is rotatably supported by the frame members 67 and 59 and carries a pulley 61 which receives a belt 62 that is driven by pulley 63 that is attached to the output shaft of a driving motor 64. Thus, as the motor rotates the lead screw 57 is rotated so as to move the carriage 43.

A pair of upright members 47 and 48 are mounted on the carriage 43 and carry an upper cross-member 49 which supports a threaded lead screw 51 with a handle 52 thereon which is threadedly received through an adjustable cross-member 53 which can be moved on guides 54 and 56 in the vertical direction.

Figure 4:
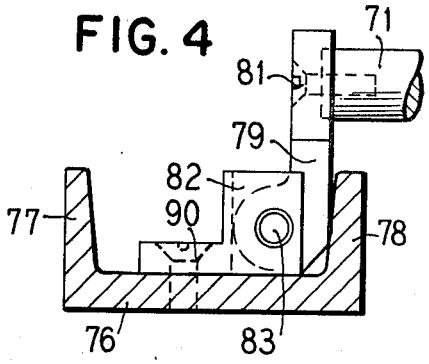
FIG. 4 is a sectional view illustrating the gauging channel member.

Gauging finger support shafts 71 and 72 are received through openings in the opposite ends of the cross-member 53 and can be locked in a selected position by set screws 73 and 74. A gauging channel 76 is attached to the ends of the shafts 71 and 72 as shown, for example, in FIG. 4 by an L-shape member 79 which has a vertical portion which is attached to the end of the shaft 71 by a set screw 81 and a horizontal portion 82 which is pivoted by shaft 83 to the portion 79. The portion 82 is attached to the channel 76 by set screw 90 as illustrated in FIG. 4. The gauging flange 76 will normally be in the horizontal position illustrated in FIG. 4. The front surface of the flange 77 can be used as a gauging surface. However, the flange 76 can also be pivoted upwardly about the pivot 83, and due to the position of the pivot shaft 83 normally the weight of the flange 76 will hold it in the position illustrated in FIG. 4.

Although the front face of the flange 77 can be used as a gauging surface it is often times desirable to use the novel gauging fingers of the invention 88 and 89 which are mounted in support housings 86 and 87 and which attach to the front flange 77 of the gauging channel 76 as illustrated in FIGS. 3 and 6 through 10. The gauging finger holders 86 and 87 are identical and only one gauging finger 87 will be described. As shown in FIGS. 7 through 10, the gauging finger 87 is formed with a slot between a pair of locking fingers 101 and 102 and a locking shaft 104 is threadedly received through the leg 102 and has a knob 103 so as to allow the end 106 of the shaft 104 lock the gauging finger 87 to the front portion 77 of channel member 76. The legs 101 and 102 connect to a main body portion 106 which is formed with an upper slot in which a pivoting finger holder member 111 is received. The back face 151 of the finger holder member 111 is curved and engages the end of a shaft 113 which passes through a threaded opening 114 and has a knob 112 so as to adjust the forward and rearward position of the finger holder member 111. A pair of L-shaped side slots 109 and 110 are formed in the member 106 and L-shaped shafts 121 and 122 are attached to the finger holder member 111 and allow the finger holder member 111 to pivot relative to the member 106 due to rotation of the shafts 121 and 122 in the slots 109 and 110. The lower ends of the shafts 121 and 122 are curved and are respectively connected to springs 123 and 124 which have their opposite ends connected to extending shafts 126 and 127 mounted in the body portion 106 so as to spring bias the pivoted finger holding members 111 to the down position illustrated in FIG. 7. At the end of the pivoted finger holding member 111 is formed an opening in which the finger 89 is rotatably received. Detents 152 are formed in the finger 89 as illustrated in FIGS. 8, 9 and 10 and a detent is formed by set screw 161 which passes through the lower wall of the pivoted finger holder 111 such that its spring loaded end can be received in the detent holes 152 to hold the finger 89 in a present rotary position.

The upper surface of the finger 89 is flatted as shown in FIG. 7 and the end 131 serves as the gauging surface. The lower surface of the gauging finger is removed as illustrated at 165.

In operation, the backgauge can be utilized with the channel 76 as the backgauge using its front surface as illustrated in FIG. 4 or, alternatively, the gauging members 86 and 87 may be mounted on the front portion 77 of the gauging channel 76 by locking the members 86 and 87 to the front portion 77 of the channel 76 with the knobs 103. The front and back position of the fingers 89 can be adjusted with the knob 112 so as to move the pivoted finger holding member 111 to a predetermined position depending upon the setting of the shaft 114 by the knob 112.

The fingers 89 and 88 can be utilized in the positions illustrated in FIGS. 7 through 9 or they can be rotated by 90° and utilized in the position illustrated in FIG. 10.

It is seen that this invention provides a new and novel gauging finger support and mechanism and although it has been described with respect to preferred embodiments, it is not to be so limited as changes and modifications may be made therein which are within the full intended scope as defined by the appended claims.

We claim as our invention:

1. A metal working machine including a frame member with a first die, a movable ram supported on said frame, a second die carried by said ram to engage and form metal in cooperation with said first die, driving means for said ram, a movable backgauge assembly engageable with said metal to index the assembly attached to said frame, a pair of parallel horizontal guide shafts for said backgauge attached to said frame, a carriage with a pair of ways in which said guide shafts are received, a lead screw rotatable attached to said frame and threadedly received by said carriage, carriage drive means connected to said lead screw to drive said carriage away from and toward said first and second dies, a pair of upright members attached to said carriage, a horizontal member attached to said pair of upright members, a pair of parallel horizontally extending support bars attached to opposite ends of said horizontal member, a gauging channel member attached to the ends of said pair of horizontally extending support bars which are nearest to said first and second dies, a pair of spaced gauging finger supports attached to the edge of said gauging channel member nearest said first and second dies, said gauging finger supports each including a body member with a top groove formed therein which extends to the front surface nearest said first and second dies, a rectangular shaped finger holder formed with a hemispherical rear surface mounted in said top groove, a pair of L-shaped slots formed in said body member, a pair of L-shaped arms attached to said finger holder and extending through said L-shaped slots, spring means attached to said L-shaped arms to bias said finger holder to a horizontal position in said groove, and a gauging finger mounted in said finger holder, including a threaded adjustment shaft threadedly received in said body member with one end engageable with said hemispherical surface of said finger holder and adjustable to vary the position of body member toward and away from said first and second dies, wherein said finger holders can be rotated upwardly out of said groove against the bias of said spring means such that said hemispherical surface of said finger holder slides on the end of said threaded adjustment shaft, and wherein said gauging finger is a round shaft with an extending flatted surface.

2. A metal working machine according to claim 1 wherein said gauging channel member is pivotally attached to the ends of said pair of horizontally extending support bars.

3. A metal working machine according to claim 1 wherein the gauging finger is mounted in said finger holder so that it can be rotated about a horizontal axis which is parallel to said horizontally extending support bars.

4. A metal working machine according to claim 3 including detent depressions formed in said gauging finger and a spring loaded detent mounted in said finger holders with one end receivable in said detent depressions.

* * * * *